US009616981B2

(12) United States Patent
Hsu

(10) Patent No.: US 9,616,981 B2
(45) Date of Patent: Apr. 11, 2017

(54) DRY SNORKEL FOR DIVING

(71) Applicant: Dong Guan Qishi Dongshan Junming Plastic & Metal Factory, Dongguan (CN)

(72) Inventor: Chiencheng Hsu, Dongguan (CN)

(73) Assignee: DONG GUAN QISHI DONGSHAN JUNMING PLASTIC & METAL FACTORY, Dongguan, Guangdong (CN)

( * ) Notice: Subject to any disclaimer, the term of this patent is extended or adjusted under 35 U.S.C. 154(b) by 406 days.

(21) Appl. No.: 14/515,429

(22) Filed: Oct. 15, 2014

(65) Prior Publication Data

US 2016/0107734 A1 Apr. 21, 2016

(51) Int. Cl.
*B63C 11/20* (2006.01)

(52) U.S. Cl.
CPC ..... *B63C 11/205* (2013.01); *B63C 11/207* (2013.01)

(58) Field of Classification Search
CPC ..... B63C 11/16; B63C 11/18; B63C 11/20; B63C 11/205; B63C 11/207; B63C 2011/165; B63C 2011/182
USPC ..... 128/200.29, 201.11, 201.27
See application file for complete search history.

(56) References Cited

U.S. PATENT DOCUMENTS 2,815,751 A * 12/1957 Ferraro ..... B63C 11/16 128/201.11
4,655,212 A * 4/1987 Delphia ..... B63C 11/205 128/201.11
5,960,791 A * 10/1999 Winefordner ..... B63C 11/205 128/201.11
7,069,927 B1 * 7/2006 Pan ..... B63C 11/205 128/201.11
7,165,545 B1 * 1/2007 Shiue ..... B63C 11/205 128/201.11
8,479,726 B2 * 7/2013 McAuley ..... A61M 16/06 128/200.24
2002/0088460 A1 * 7/2002 Monnich ..... B63C 11/205 128/201.11
2004/0226557 A1 * 11/2004 Shiue ..... B63C 11/205 128/201.11
2005/0274380 A1 * 12/2005 Shiue ..... B63C 11/205 128/201.11
2008/0047552 A1 * 2/2008 McCarthy ..... B63C 11/205 128/201.11
2008/0092883 A1 * 4/2008 Shiue ..... B63C 11/205 128/201.11

(Continued)

*Primary Examiner* — (Jackie) Tan-Uyen T Ho
*Assistant Examiner* — Joseph D Boecker

(57) ABSTRACT

A dry snorkel for diving comprises a snorkel tube, a float valve and a dry-type top discharge head. A soft plastic waterproof ring is mounted on a top end of the snorkel tube. The soft plastic waterproof ring has an air inlet communicating with the snorkel tube. A curved part is formed on the top end of the snorkel tube. The float valve is pivotally connected to a lower portion of the curved part. When a snorkel is under water, the float valve is turned up by the buoyancy of water to close the air inlet. When the top of the snorkel is above water, the float valve is turned down to open the air inlet. This design is simple and easy to assemble. It has few components and decreases the occurrence of choking on water efficiently whereby the diver breathes easily and comfortably and prolongs the diving time.

7 Claims, 7 Drawing Sheets

(56) References Cited

U.S. PATENT DOCUMENTS

| | | | | |
|---|---|---|---|---|
| 2008/0308099 | A1* | 12/2008 | Keith | B63C 11/205 128/201.11 |
| 2010/0132701 | A1* | 6/2010 | Fukasawa | B63C 11/205 128/201.11 |
| 2010/0229858 | A1* | 9/2010 | Wheelwright | B63C 11/205 128/201.11 |
| 2014/0014096 | A1* | 1/2014 | Godoy | B63C 11/205 128/201.11 |

* cited by examiner

DRY SNORKEL FOR DIVING

BACKGROUND OF THE INVENTION

1. Field of the Invention

The present invention relates to the diving equipment, and more particularly to a dry snorkel for diving.

2. Description of the Related Art

Currently, the snorkel is divided into a wet-type snorkel and a dry-type snorkel. The dry snorkel in the market usually comprises the following components: A. Air inlet: the user can breathe in and breathe out when the air inlet is above water while skin diving on the water surface. B. Tube: it has two parts, namely a hard tube and a soft tube. The basic length of the tube is 46-48 cm. The overlong tube may affect the discharge of carbon dioxide. The function of the soft tube is to adjust the angle of the snorkel with respect to the mouth conveniently whereby the user's mouth can feel more comfortable. C. Mouthpiece: A good-quality snorkel may set an inclined design to fit in with the mouth shape and the face so that the user's mouth feels less fatigued in the sport of skin diving. D. Discharging valve: It comprises a downward water outlet and a silicone membrane (similar to the cardiac valve of the heart) functioning as a unidirectional discharging element. It can blow part of water in the tube off via the water outlet very easily and prevent the seawater from entering the tube. E. Float valve: It is exclusive for the dry snorkel. When the air inlet of the snorkel is under the water surface, the float valve closes the air inlet to prevent the entry of seawater into the tube.

The dry snorkels in the market have different combinations by using the above components. These components arranged in different places have the great influence on the breath-changing and the anti-choking property of the snorkel. The disadvantages are mainly shown in the following situations: water often intrudes into the air inlet when there is the rough seawater or a deep diving action, which makes the diver swallow the water unexpectedly and choke on water. Therefore, the dangers of the diving sport still exist. Further, the problem attendant on the unreasonable arrangement of the typical upper water-discharging structure is more components, which increases the difficulty of sealability of the upper water-discharging structure and causes the complexity of the manufacturing process, the lower efficiency of production and high costs. Therefore, it still needs improvements.

SUMMARY OF THE INVENTION

The object of the present invention is to overcome the aforementioned problems and to provide a dry snorkel for diving which has a float valve pivotally connected to the lower portion of a curved part at the top end of the snorkel and allows the float valve to close and open the air inlet easily, thereby decreasing the occurrence of choking on water efficiently and allowing the diver to breathe easily and comfortably and prolong the diving time .

To obtain the above object, the technique adopted by the present invention is described as follows:

The dry snorkel for diving in accordance with the present invention comprises a snorkel tube, a float valve and a dry-type top discharge head. A soft plastic waterproof ring is mounted on a top end of the snorkel tube. The soft plastic waterproof ring forms an air inlet communicating with the snorkel tube. The top end of the snorkel tube is defined by a curved part. A lower portion of the curved part is pivotably connected to the float valve which is capable of being turned up and down, whereby the float valve is turned up to close the air inlet by the buoyancy of water when a snorkel is under water and the float valve is turned down to open the air inlet when a top of the snorkel is above water.

Preferably, an axial hole is integrally formed at the lower portion of the curved part of the snorkel tube. A rotating shaft is disposed through the axial hole. The float valve is connected to the rotating shaft.

Preferably, the dry-type top discharge head covers the float valve. A water outlet is formed at a lower portion of the dry-type top discharge head, whereby the float valve goes down freely to a limiting place at the lower portion of the dry-type top discharge head and a spherical surface of the float valve emerges from the dry-type top discharge head via the water outlet when the float valve is turned down to open the air inlet.

Preferably, a top end of the dry-type top discharge head forms an air outlet. The air outlet and the water outlet are spaced apart to form a wave-proof plate therebetween.

Preferably, the dry-type top discharge head and the curved part of the snorkel tube are combined with a quick-detachable snap fit.

Preferably, the dry-type top discharge head comprises a slantingly-mounted end corresponding to an inclined block disposed on the curved part of the snorkel tube. The slantingly-mounted end is disposed against the inclined block.

Preferably, the soft plastic waterproof ring and the top end of the snorkel tube are combined with a quick-detachable snap fit.

By comparison with the prior technique, the present invention has some advantages and beneficial effects. Specifically, the present invention takes advantage of the float valve pivotally connected to the lower portion of the curved part at the top end of the snorkel. Therefore, the float valve rises freely by the buoyancy of water and thence closes the air inlet when it is under water, thereby preventing the intrusion of the seawater. The float valve goes down freely by its own gravity and thence opens the air inlet when it is above water, which allows the diver to change his breath. This design is simple and easy to assemble. It has few components and decreases the occurrence of choking on water efficiently whereby the diver breathes easily and comfortably and prolongs the diving time.

The present invention is further described upon reading following preferred embodiments in conjunction with the accompanying drawings.

DETAILED DESCRIPTION OF THE PREFERRED EMBODIMENTS

Figure 1:
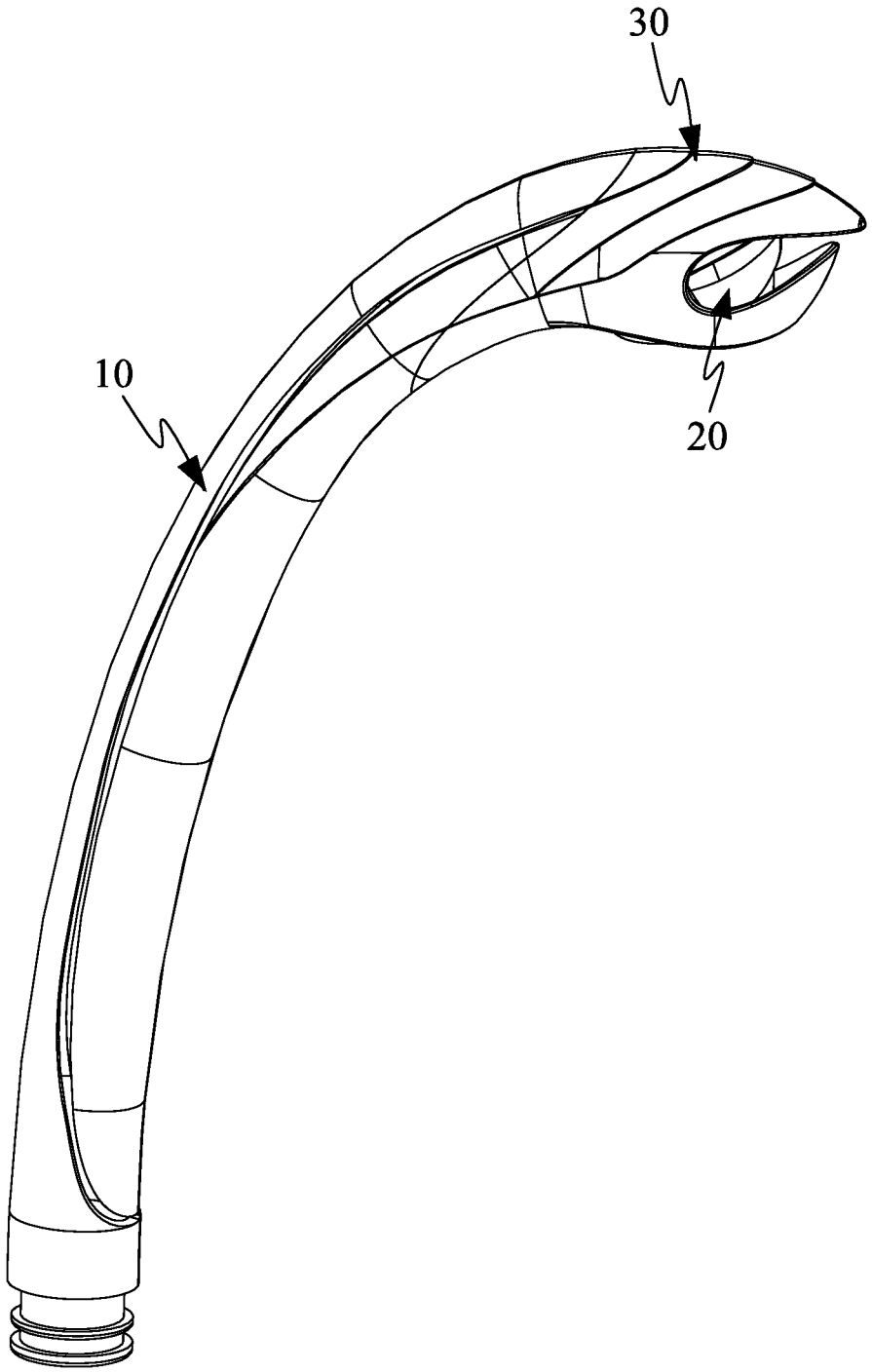
FIG. 1 is a perspective view showing the full structure of the dry snorkel of a preferred embodiment of the present invention.
Figure 2:
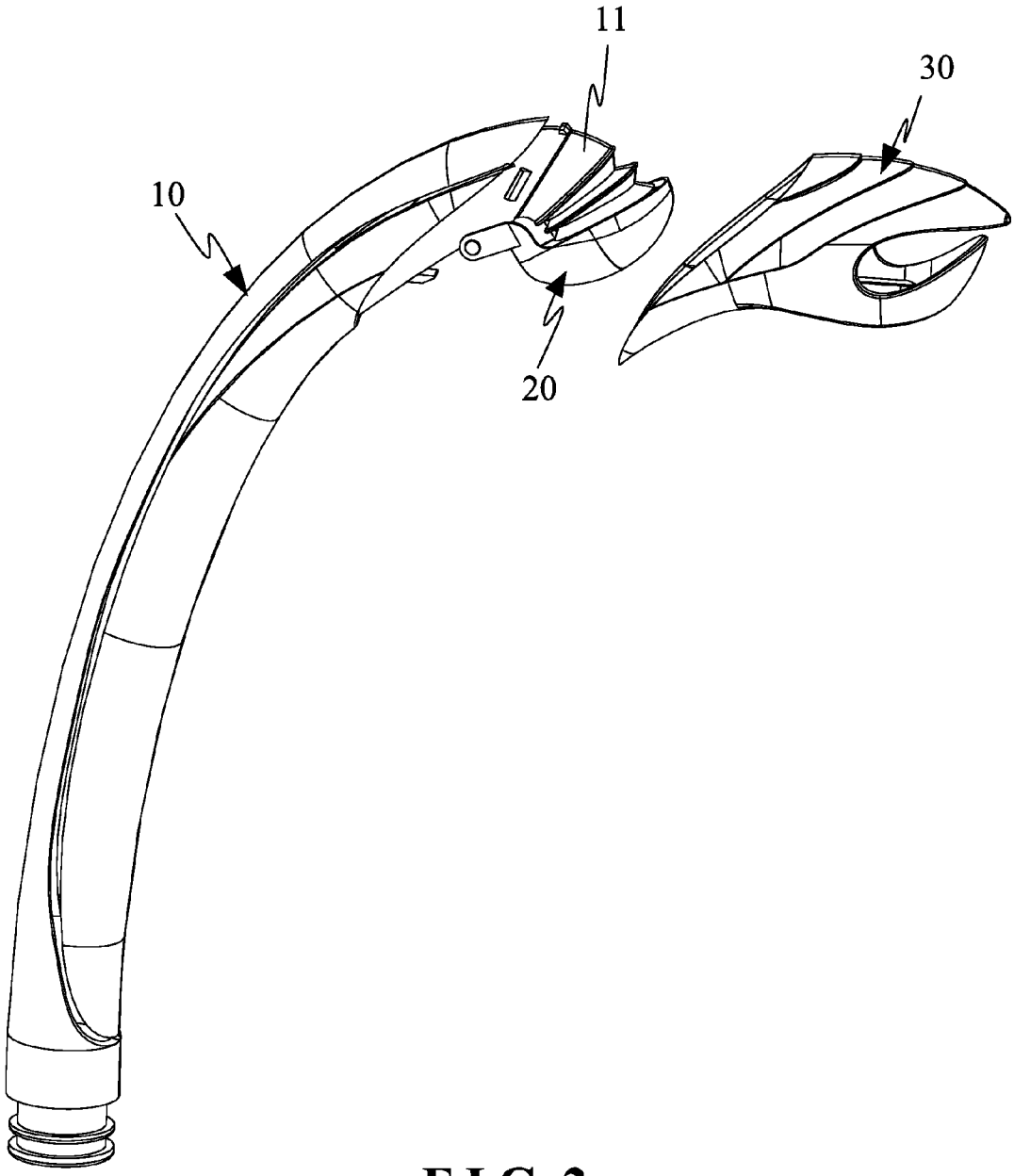
FIG. 2 is a perspective view showing the dry-type top discharge head detached from the snorkel tube of the preferred embodiment of the present invention.
Figure 3:
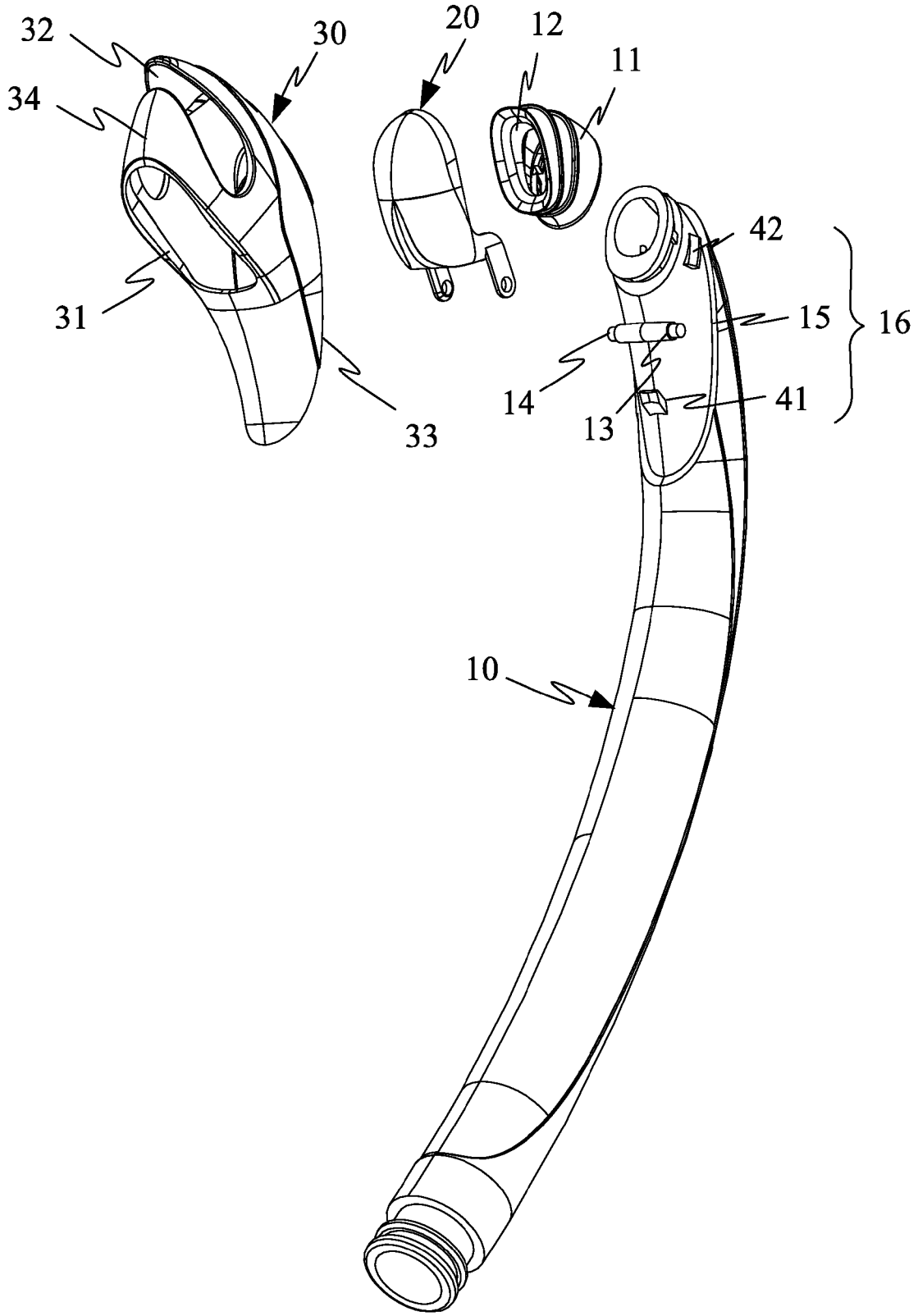
FIG. 3 is an exploded view showing the dry snorkel of the preferred embodiment of the present invention.
Figure 4:
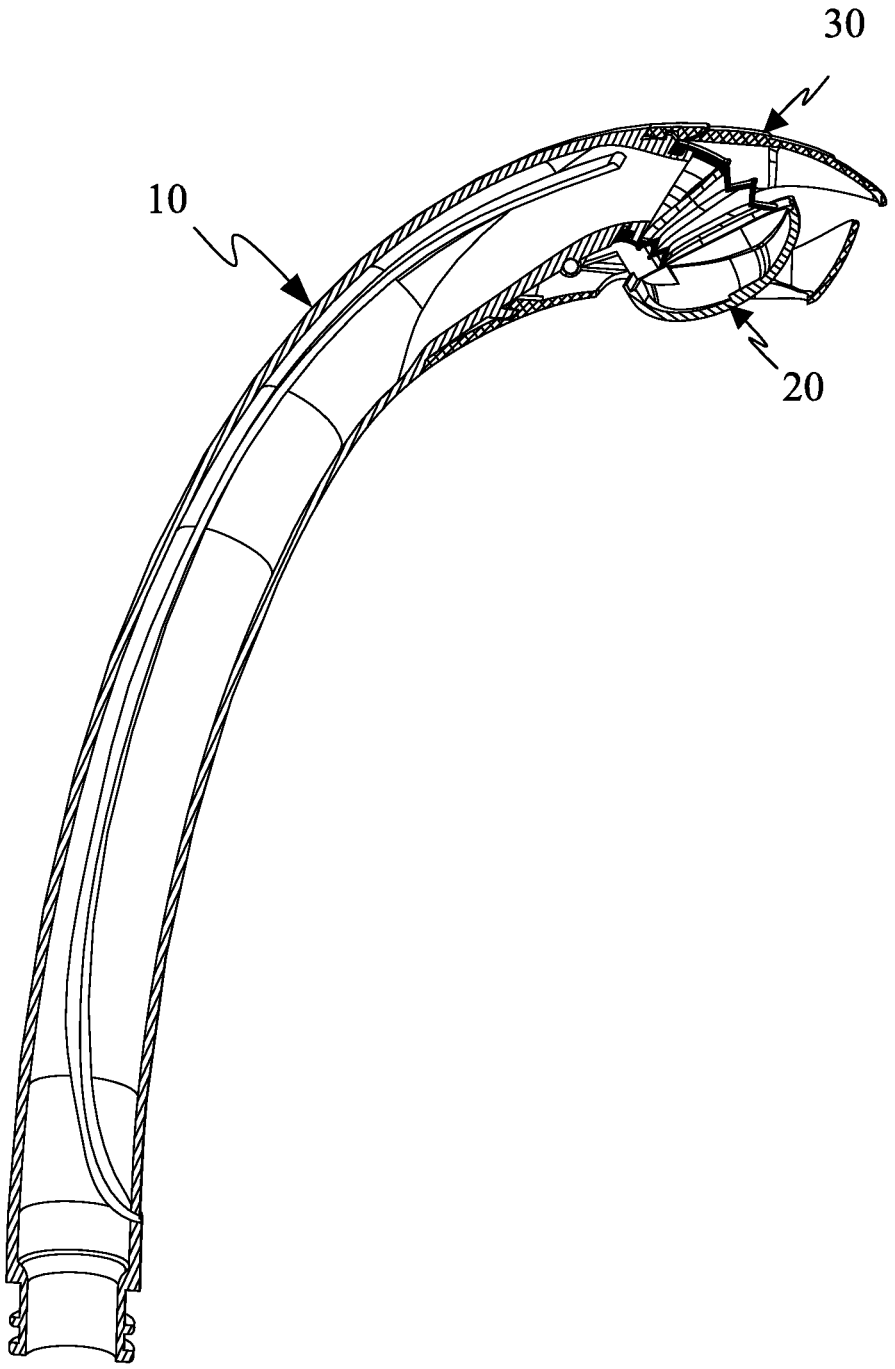
FIG. 4 is a cross-sectional view showing the dry snorkel of the preferred embodiment of the present invention.
Figure 5:
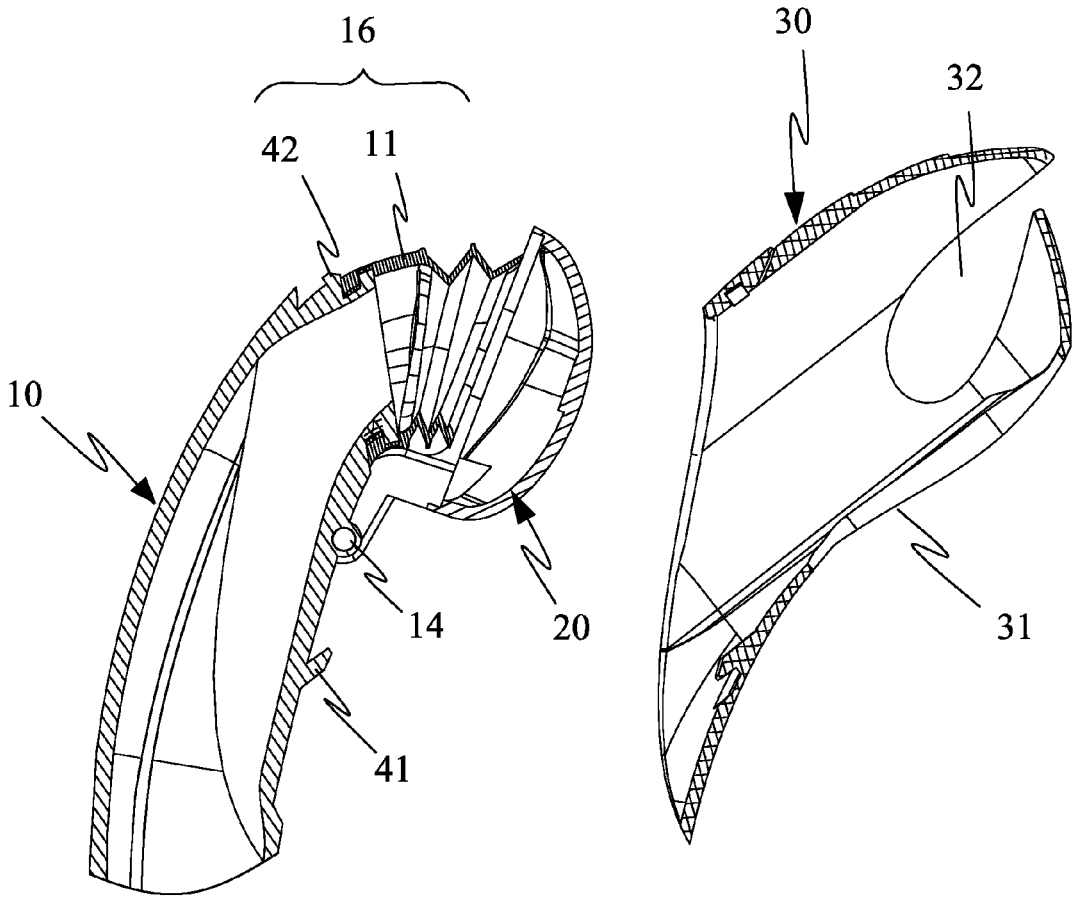
FIG. 5 is a partially cross-sectional view showing the top of the dry snorkel of the preferred embodiment of the present invention.

Referring to FIGS. 1-5, a preferred embodiment of a dry snorkel for diving of the present invention comprises a snorkel tube 10, a float valve 20 and a dry-type top discharge head 30.

Wherein, the snorkel tube 10 is made of a hard material. A soft plastic waterproof ring 11 is mounted on a top end of the snorkel tube 10 and provided with a retractile capability. An air inlet 12 is formed on the soft plastic waterproof ring 11 and communicates with the snorkel tube 10. The top end of the snorkel tube 10 is defined by a curved part 16. A lower portion of the curved part 16 is pivotably connected to the float valve 20 which is capable of being turned up and down. The float valve 20 is in a hemispherical shape and made of a lightweight material, a density of which is smaller than the density of water. When a snorkel is under water, the float valve 20 rises by the buoyancy of the water, and then it is turned up along the rotating shaft 14 to close the air inlet 12. Owing to the retractility of the soft plastic waterproof ring 11, the sealability of the float valve 20 on the soft plastic waterproof ring 11 is better in order to prevent the intrusion of seawater from choking the user. When a top of the snorkel is above water, the float valve 20 goes down by the gravity, and then it is turned down along the rotating shaft 14 to open the air inlet 12. Therefore, the user can change the breath at this stage.

Specifically, an axial hole 13 is integrally formed at the lower portion of the curved part 16 of the snorkel tube 10. A rotating shaft 14 penetrates the axial hole 14. The float valve 20 is connected to the rotating shaft 14 to allow the float valve 20 to be turned up and down along the rotating shaft 14. This design has a simple structure and allows the air inlet 12 to be opened and closed very conveniently.

The dry-type top discharge head 30 covers the float valve 20. A water outlet 31 is formed at a lower portion of the dry-type top discharge head 30. When the float valve 20 is turned down to open the air inlet 12, the float valve 20 emerges from the dry-type top discharge head 30 via the water outlet 31. Furthermore, a top end of the dry-type top discharge head 30 forms an air outlet 32. The air outlet 32 and the water outlet 31 are spaced apart to form a wave-proof plate 34 therebetween, thereby preventing the water from entering the air inlet 12 and decreasing the occurrence of choking on water. Therefore, the user can breathe comfortably and easily.

During the installation, the dry-type top discharge head 30 and the curved part 16 of the snorkel tube 10 are combined with a quick-detachable snap fit 41. The dry-type top discharge head 30 comprises a slantingly-mounted end 33 corresponding to an inclined block 15 disposed on the curved part 16 of the snorkel tube 10. The slantingly-mounted end 33 is disposed against the inclined block 15 whereby they can be in a snap-fit combination by arranging the snap fit 41 and a snap point 42 on matching surfaces. The soft plastic waterproof ring 11 and the top end of the snorkel tube 10 are also combined with a quick-detachable snap fit 41 in order to facilitate the rapid replacement and detachment of components when the components are broken and obtain a simple installation.

Figure 6:
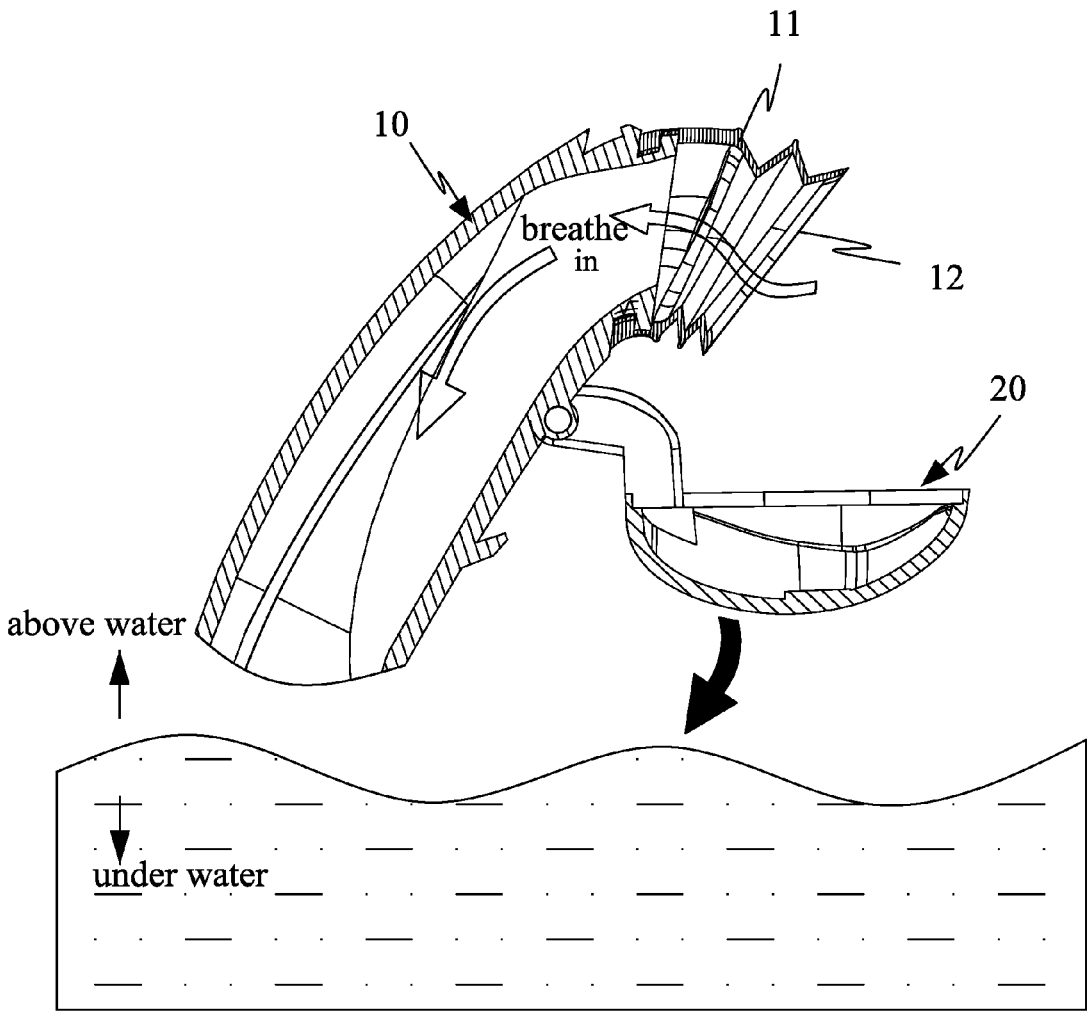
FIG. 6 is a schematic view showing the preferred embodiment of the present invention is used above water.
Figure 7:
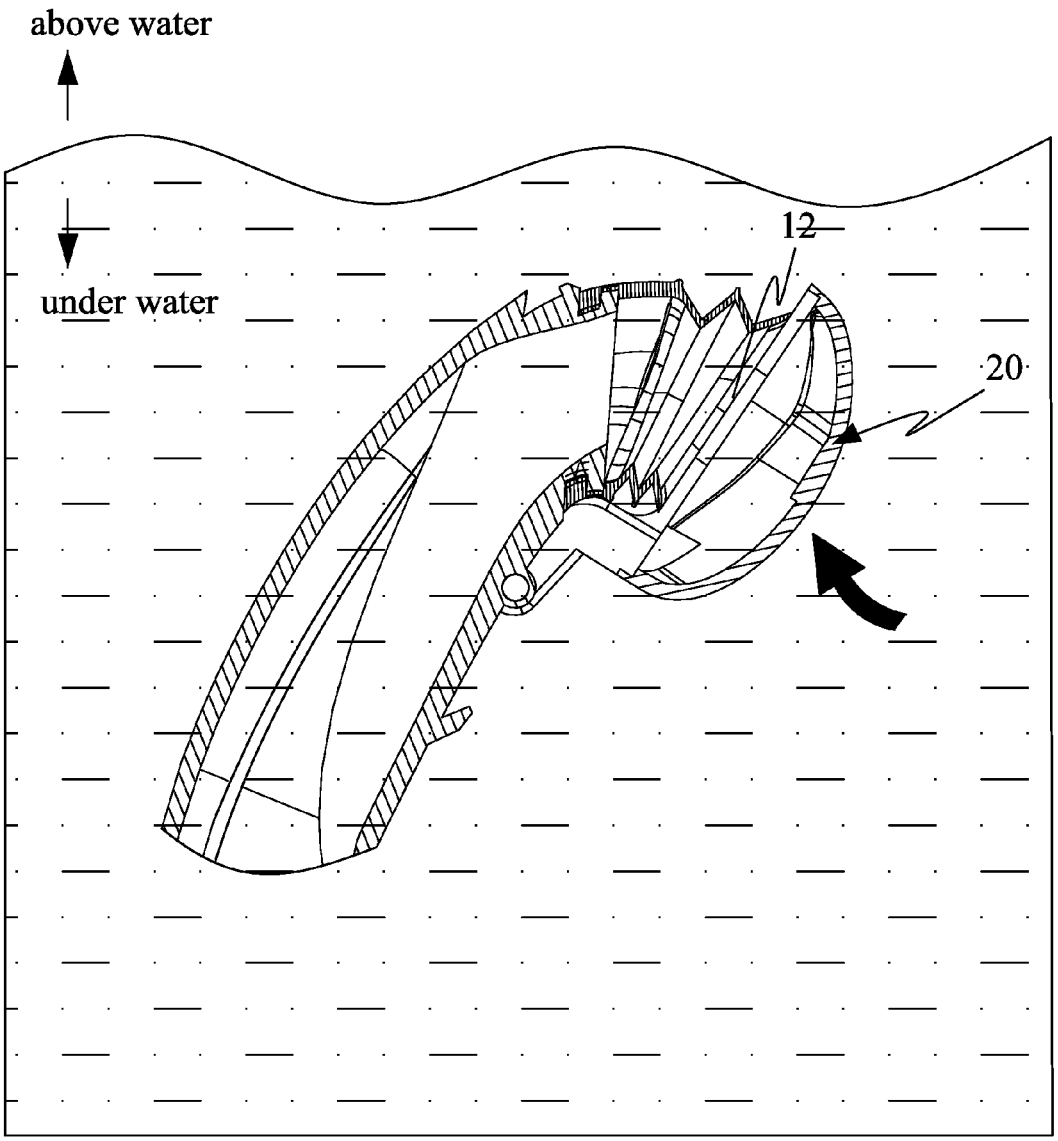
FIG. 7 is a schematic view showing the preferred embodiment of the present invention is used under water.

FIG. 6 and FIG. 7 show the dry snorkel of the present invention in use. While skin diving on the sea, the diver has to lock the dry-type top discharge head 30 with the top end of the snorkel tube 10. When the diver dives to place the snorkel under water, the float valve 20 rises by the buoyancy of water whereby it is turned up along the rotating shaft 14 to close the air inlet 12. Therefore, the occurrence of the intrusion of seawater and choking on the seawater can be prevented. When the top of the snorkel is above water, the float valve 20 goes down to a limiting place at the lower portion of the dry-type top discharge head 30 because of the gravity. The spherical surface of the float valve 20 emerges from the dry-type top discharge head 30 via the water outlet 31, and then the float valve 20 is turned down along the rotating shaft 14 to open the air inlet 12 whereby the diver can change his breath. Concurrently, the dry-type top discharge head 30 can use the wave-proof plate 34 possibly to prevent the seawater from entering the air inlet 12, thereby decreasing the occurrence of choking on water.

To sump up, the present invention takes advantage of the float valve 20 to be pivotally connected to the lower portion of the curved part 16 at the top end of the snorkel. Therefore, the float valve 20 rises freely by the buoyancy of water to close the air inlet 12 when it is under water and prevent the entry of the seawater. The float valve 20 goes down freely by its own gravity to open the air inlet 12 when it is above water, which allows the diver to change his breath. This design is simple and easy to assemble. It has few components and decreases the occurrence of choking on water efficiently whereby the diver breathes easily and comfortably and prolongs the diving time.

While the embodiment in accordance with the present invention is shown and described, it is understood that further variations and modifications may be made without departing from the scope of the invention.

What is claimed is:

1. A dry snorkel for diving comprising a snorkel tube, a float valve and a dry-type top discharge head, a soft plastic waterproof ring being mounted on a top end of and extending from said snorkel tube, said soft plastic waterproof ring being provided with an air inlet which communicates with said snorkel tube, wherein said top end of said snorkel tube is defined by a curved part, a lower portion of said curved part being pivotably connected to said float valve capable of being turned up and down, whereby said float valve is turned up to close said air inlet when said snorkel is under water and said float valve is turned down to open said air inlet when a top of said snorkel is above water.

2. The dry snorkel for diving according to claim 1, wherein an axial hole is integrally formed at said lower portion of said curved part of said snorkel tube, a rotating shaft being disposed through said axial hole, said float valve being connected to said rotating shaft.

3. The dry snorkel for diving according to claim 1, wherein said dry-type top discharge head covers said float valve, a water outlet being formed at a lower portion of said dry-type top discharge head, said float valve goes down freely to a limiting place at said lower portion of said dry-type top discharge head and a spherical surface of said float valve emerges from said dry-type top discharge head via said water outlet when said float valve is turned down to open said air inlet.

4. The dry snorkel for diving according to claim 3, wherein a top end of said dry-type top discharge head forms an air outlet, said air outlet and said water outlet being spaced apart to form a wave-proof plate therebetween.

5. The dry snorkel for diving according to claim 1, wherein said dry-type top discharge head and said curved part of said snorkel tube are combined with a quick-detachable snap fit.

6. The dry snorkel for diving according to claim 5, wherein said dry-type top discharge head comprises a slantingly-mounted end corresponding to an inclined block disposed on said curved part of said snorkel tube, said slantingly-mounted end being disposed against said inclined block.

7. The dry snorkel for diving according to claim 1, wherein said soft plastic waterproof ring and said top end of said snorkel tube being combined with a quick-detachable snap fit.

* * * * *